US011566452B1

(12) United States Patent
Waddle

(10) Patent No.: US 11,566,452 B1
(45) Date of Patent: Jan. 31, 2023

(54) CABLE TIE RESTRAINING APPARATUS

(71) Applicant: Jared Waddle, Dallas, TX (US)

(72) Inventor: Jared Waddle, Dallas, TX (US)

( * ) Notice: Subject to any disclaimer, the term of this patent is extended or adjusted under 35 U.S.C. 154(b) by 191 days.

(21) Appl. No.: 16/890,218

(22) Filed: Jun. 2, 2020

Related U.S. Application Data

(60) Provisional application No. 62/857,161, filed on Jun. 4, 2019.

(51) Int. Cl.
*E05B 75/00* (2006.01)

(52) U.S. Cl.
CPC ..... *E05B 75/00* (2013.01)

(58) Field of Classification Search
CPC ..... E05B 75/00; Y10T 70/40; Y10T 70/402; Y10T 70/404; Y10T 70/409; Y10T 70/411
USPC ..... 70/14–19; 24/16 R
See application file for complete search history.

(56) References Cited

U.S. PATENT DOCUMENTS 2,969,216 A * 1/1961 Hallsey ..... F16L 3/2332 24/302
2,971,231 A * 2/1961 Stoddart ..... F16L 3/233 206/397
3,429,985 A * 2/1969 Czigler ..... F16L 3/12 174/164
4,071,023 A 1/1978 Gregory
5,159,728 A * 11/1992 Bingold ..... E05B 75/00 D8/394
5,377,510 A * 1/1995 Smith ..... E05B 35/008 128/878
5,443,155 A * 8/1995 Robinson ..... E05B 75/00 206/223
5,802,888 A * 9/1998 Parsons ..... E05B 75/00 24/16 PB
6,219,887 B1 * 4/2001 Parsons ..... E05B 75/00 24/484
6,536,082 B2 * 3/2003 Berrocal ..... G09F 3/037 292/318
6,543,094 B2 * 4/2003 D'Addario ..... H02G 3/26 24/459
7,124,975 B2 * 10/2006 Richardson ..... B65H 75/366 242/402
7,854,042 B2 * 12/2010 Richardson ..... B65D 63/10 24/442

(Continued)

FOREIGN PATENT DOCUMENTS

WO WO-9713946 A1 * 4/1997 ..... B65D 63/1072

*Primary Examiner* — Suzanne L Barrett
(74) *Attorney, Agent, or Firm* — Law Office of Sam Sokhansanj PLLC

(57) ABSTRACT

A cable tie safety mechanism configuration is disclosed having a looped region that allows a space or opening within the cable tie such that it can be cut or sheared from a restrained person without the risk of injury. In particular, a safety mechanism is disclosed for a cable tie having a projection or protruding region, wherein the projection extends upwardly from a base region of a cable tie apparatus. In addition, the projection further extends or slopes in a downward configuration or orientation, wherein the sloped or downward configuration forms a hook-like configuration. Further, the projection forms an open space or gap underneath, thereby allowing a user to safely cut the cable tie near, within, or around the space or gap region of the projection without harm or injury to the restrained individuals arm, wrist, or hands, among other advantages.

12 Claims, 15 Drawing Sheets

(56) References Cited

U.S. PATENT DOCUMENTS

| | | | | |
|---|---|---|---|---|
| 2008/0189916 | A1* | 8/2008 | Geiger | F16L 3/2332 24/191 |
| 2008/0229550 | A1* | 9/2008 | Elsner | B60R 16/0215 24/16 PB |
| 2009/0205379 | A1 | 8/2009 | Williams | |
| 2010/0146742 | A1* | 6/2010 | Every | B65D 63/1063 24/16 PB |
| 2010/0236030 | A1* | 9/2010 | Dyer | F16L 57/00 24/16 PB |
| 2012/0180270 | A1* | 7/2012 | Marmelstein | B65D 63/1018 24/16 R |
| 2013/0014350 | A1* | 1/2013 | Lie | B65D 63/1018 24/16 PB |

* cited by examiner

CABLE TIE RESTRAINING APPARATUS

CROSS REFERENCE TO RELATED APPLICATIONS

This application claims the benefit of U.S. Provisional Application No. 62/857,161 filed on Jun. 4, 2019, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

The use of flexible straps to secure bundles of wire or cable is well known along with their use by law enforcement, military, and professional security personnel. Typical devices using this concept consist of an elongated strap with a lock on one end. The strap is placed around the wrist of the person to be secured, and then the free end of the strap is drawn through the lock and the loop is tightened. The lock generally includes a ratchet arrangement that engages a set of teeth, grooves or holes on the free end of the strap. The loop is made tight by drawing the free end of the strap through the locking devise. The ratchet with the teeth maintains the tightened condition. Such devices are commonly referred to as "cable ties." Cable ties have been used by a number of law enforcement agencies and the military for quite a numbers of years. This is due to the lightweight and ease of use and cost efficiency. Moreover, cable ties allow law enforcement to secure large numbers of people quickly and cost effectively, which makes them very popular for all types of security professionals.

However, a significant drawback to the use of ordinary cable ties as restraining devices is that most of them can be used only once and must be cut. Specifically, it is necessary to cut the strap with a pair of wire cutters or a similar shearing tool when the restrained person is to be freed. In fact, it is necessary to cut the strap and apply another cable tie if the person is not to be freed but merely because the loop was too tight on the person. Moreover, if the cable tie loop is placed on too tight, it can cause damage to the retrained persons wrists, hands, and/or arms. Further, the risk to causing physical harm to the restrained person while the cable tie is being cut by shears or a cutting tool is very high. Specifically, the use of wire cutters or shears at or near the loop can potentially and inadvertently cut, scratch, stab, or gouge the restrained person while another person is attempting to cut the cable tie loop.

Accordingly, there is a need for a cable tie configuration that can not only be comfortable for the restrained person, but also minimize or eliminate the risk of injury while the cable tie is being cut.

BRIEF SUMMARY

In one aspect of the disclosure described herein, a cable tie safety mechanism configuration is disclosed having a looped region that allows a space or opening within the cable tie such that it can be cut or sheared from a restrained person without the risk of injury. In particular, a safety mechanism is disclosed for a cable tie having a projection or protruding region, wherein the projection extends upwardly from a base region of a cable tie apparatus. In addition, the projection further extends or slopes in a downward configuration or orientation, wherein the sloped or downward configuration forms a hook-like configuration. In addition, one end the projection can be secured to the cable tie and an opposing end being free with respect to the cable tie. Further, the projection forms an open space or gap underneath, thereby allowing a user to safely cut the cable tie near, within, or around the space or gap region of the projection without harm or injury to the restrained individuals arm, wrist, or hands, among other advantages.

In another aspect of the disclosure described herein, a cable tie or strap is disclosed having a base, and a first strap and a second strap coupled to the base. The cable tie or strap further includes a protruding member coupled to the base, wherein the protruding member includes an upstanding region and a curved sloping region. In addition, the cable tie or strap further includes wherein the protruding member extends in a downward configuration. In addition, the protruding member forms a hook configuration. Also, one end of the protruding member can be secured to the base and an opposing end can be free with respect to the base. Further, the protruding member can form an open space or gap underneath.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1A:
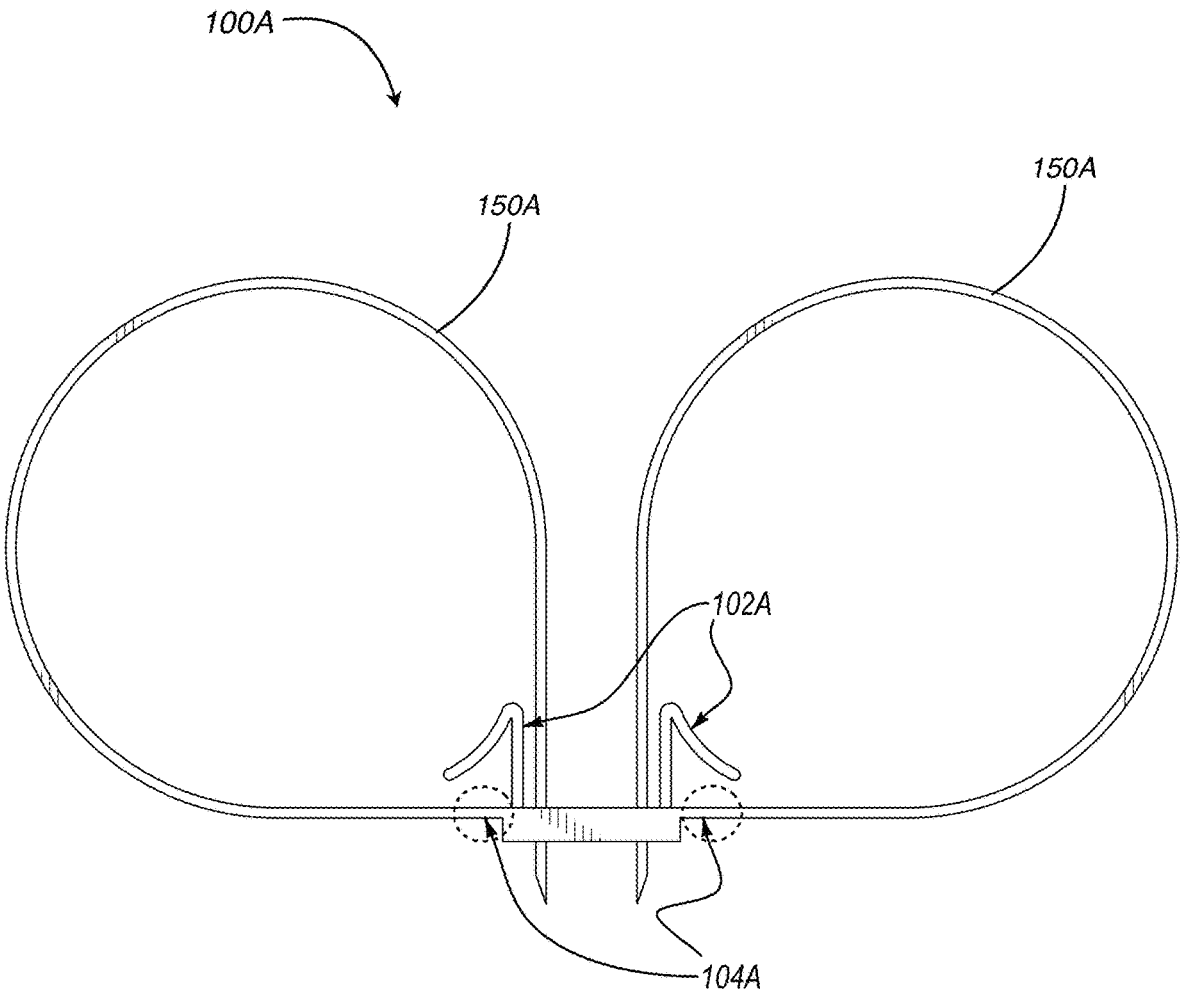
FIG. 1A illustrates a side view for one non-limiting exemplary embodiment of the cable tie restraining apparatus of the disclosure described herein, with the straps shown in a closed configuration.
Figure 1B:
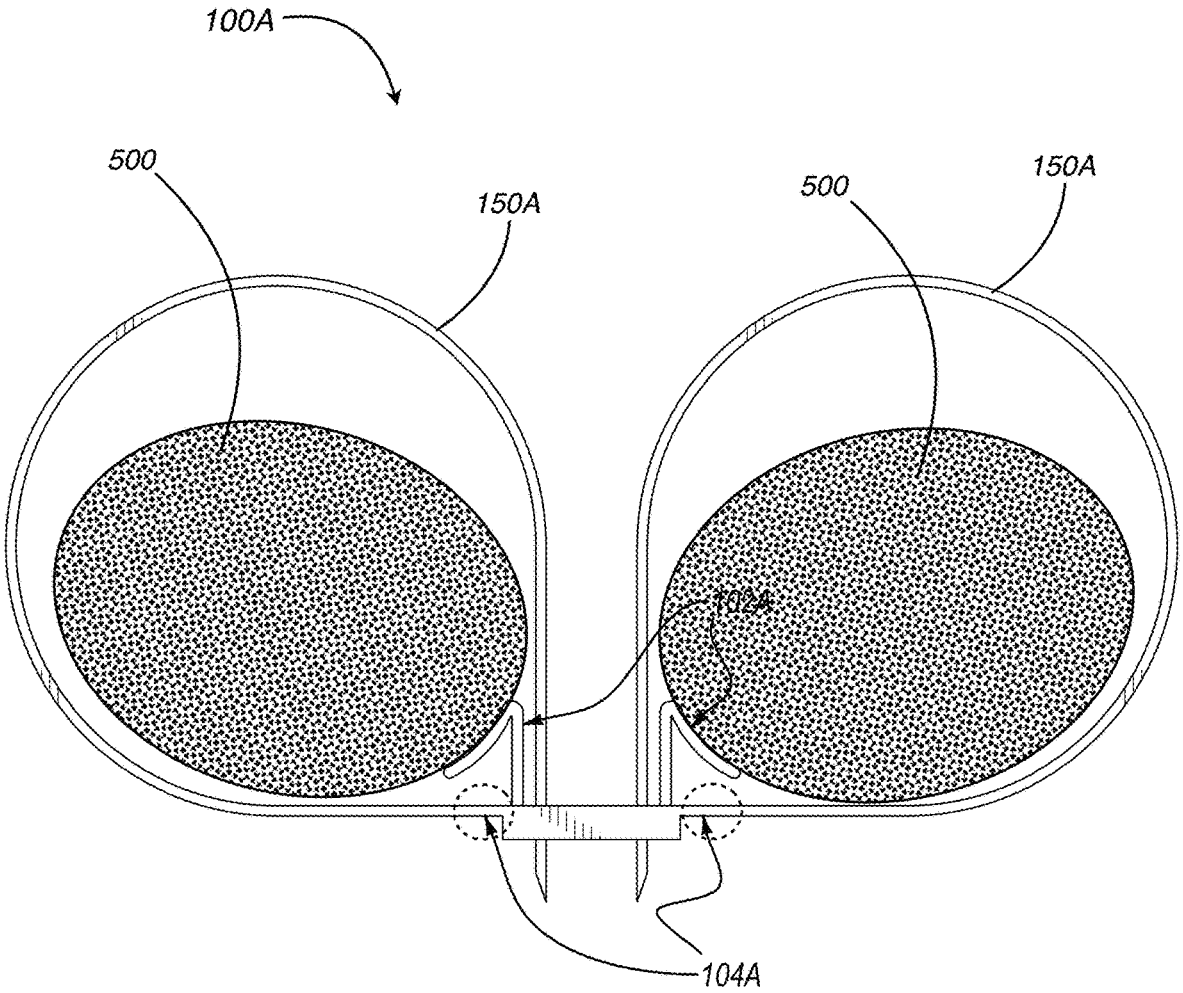
FIG. 1B illustrates a side view for the cable tie restraining apparatus of the disclosure described herein of FIG. 1A, with the straps shown in a closed configuration, and also illustrating a cross-section of a wrist enclosed within the straps.
Figure 1C:
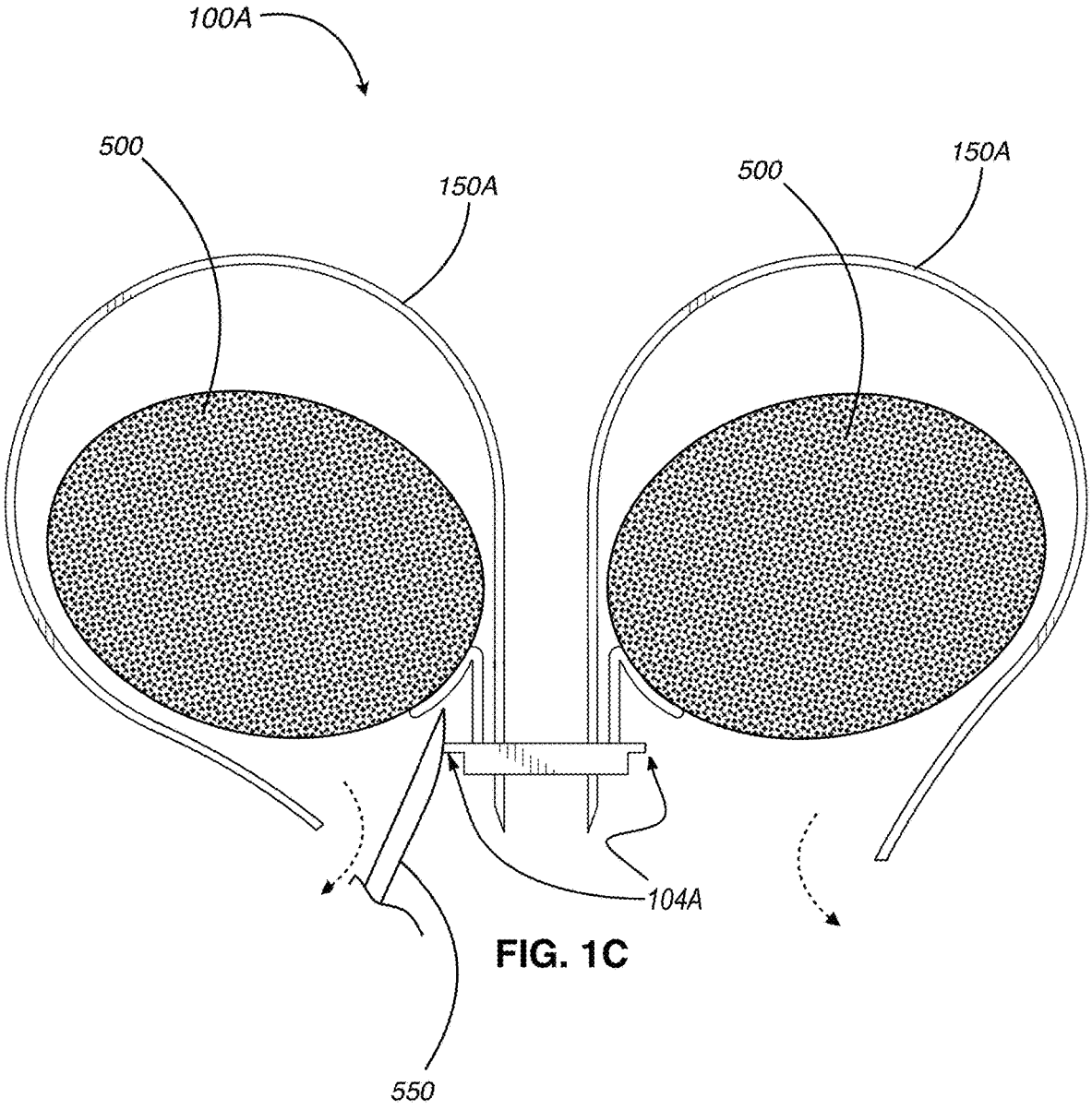
FIG. 1C illustrates a side view for the cable tie restraining apparatus of the disclosure described herein of FIG. 1A, shown with the straps severed and released, and also illustrating a cross-section of the wrist being released from within the straps.
Figure 1D:
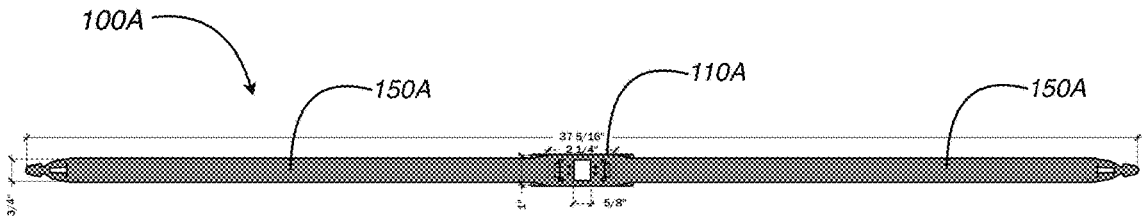
FIG. 1D illustrates a bottom view for the cable tie restraining apparatus of FIG. 1A.
Figure 1E:
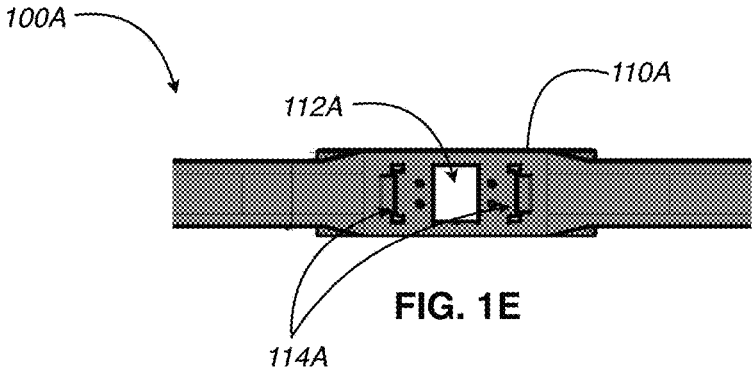
FIG. 1E illustrates a partial close-up bottom view for the cable tie restraining apparatus of FIG. 1A.
Figure 1F:
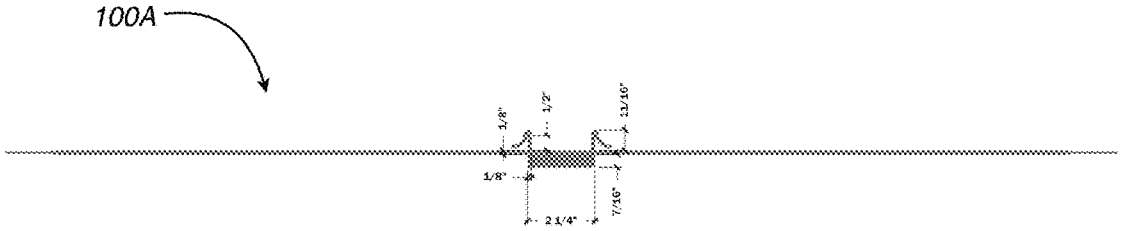
FIG. 1F illustrates a side view for the cable tie restraining apparatus of FIG. 1A.
Figure 1G:
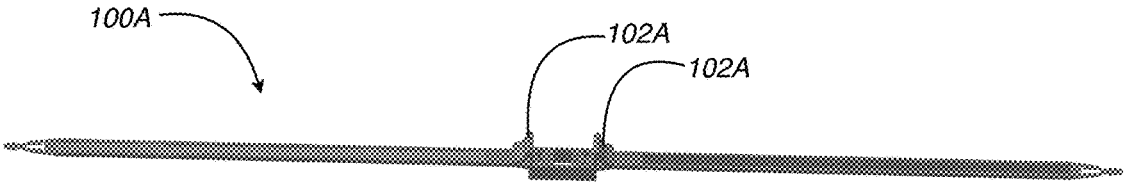
FIG. 1G illustrates a perspective top view for the cable tie restraining apparatus of FIG. 1A.
Figure 1H:
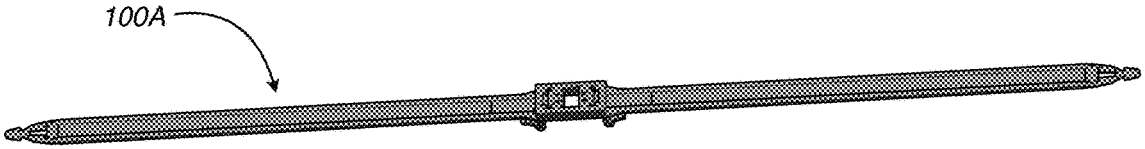
FIG. 1H illustrates a perspective bottom view for the cable tie restraining apparatus of FIG. 1A.

FIGS. 1A-1C illustrate one non-limiting exemplary embodiment of the cable tie restraining apparatus 100A of the disclosure described herein, shown with the bands, cables, or straps 150A in a looped and locked position. FIG. 1B illustrates the apparatus 100A with the straps 150A severed and detached from the base region of the apparatus. Here, the cable tie safety restraining apparatus is shown having inverted hook-like projections or protrusion members 102A having an upright or upstanding region followed by a downward sloping region having a slight curvature. Notably, the curvature can allow for more comfort to a hand or wrist 500 of the restrained person by conforming to the curvature of the hand or wrist. Further, the length of the curvature may range from 0.05 up to and including 3 in. Here, it is noted that one end of the projections 102A is secured or affixed to a base of the cable tie apparatus whereas an opposing end is not in contact with the cable tie, thereby creating a space or gap between the cable tie and projection 102A and the area under the projection 102A. In addition, the projection, its curvature and free end may have a rounded or shaved configuration. Projection 102A is further adapted to bend, articulate, and recoil. In addition, the area under projection 102A allows an operator or user to place shears or any cutting tool at region 104A of the cable tie thereby safely cutting the cable, such that the shears or cutting tool 550 does not make contact with a person's hand, arm, or wrist 500 while secured within the loop of the cable tie apparatus. Specifically, because one end of projection 102A is not attached to the cable tie, the cable tie can be successfully cut and removed from the restrained individual's wrists 500 when it is cut with a cutting tool 550 at or around region 104A, as shown in FIG. 1C. Further, the upstanding region of the can preferably be about 11/16 in.; however, it is contemplated within the scope of the present disclosure described herein that projection 102A may have any height or length, such as from 0.05 in. up to and including 2 in., or any slope or angle. In addition, the edges of projection 102A may also be rounded or shaved, and further include a smooth exterior surface.

FIGS. 1D-1H further illustrate various detailed views for the cable tie restraining apparatus embodiment of FIG. 1A shown with the bands, cables, or straps in the open flat open position. Specifically, cable tie restraining apparatus 100A is shown having a base 110A with an opening 112A therethrough. In addition, base 110A further includes a pair of openings 114A having tab like locking mechanism therein for receiving each strap 150A therein and therethrough. Specifically, once either of straps 150A are received within either of openings 114A, they may only be pulled through openings 114A in one-direction and stopped from moving in the opposing direction. Specifically, openings 114A may include a ratchet or locking type of mechanism allowing for one way movement of straps 150A. Further, opening 112A may allow the ends of straps 150A to be placed therethrough for storage purposes. In addition, opening 112A can provide structural integrity to apparatus 100A.

Figure 2:
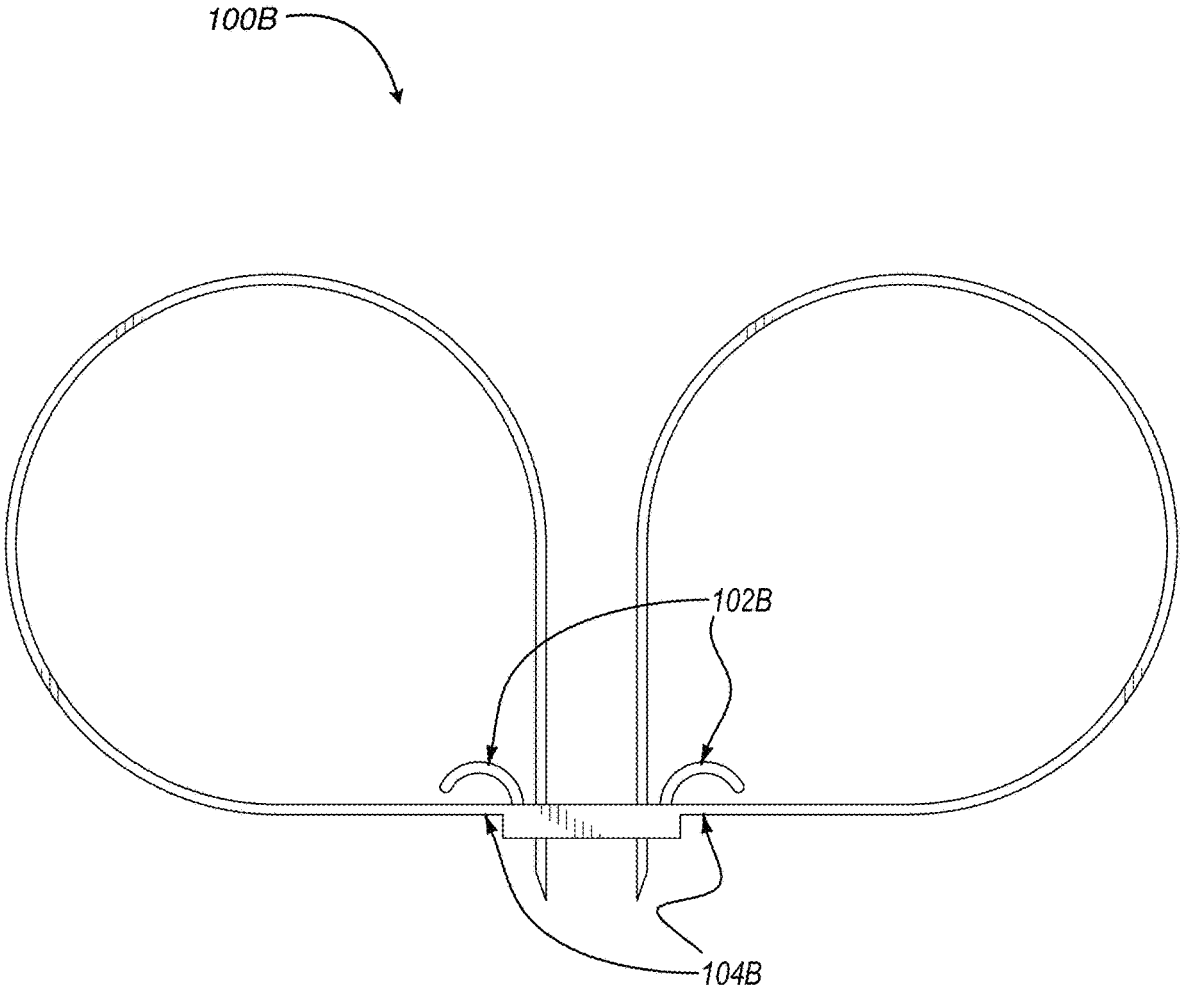
FIG. 2 illustrates a side view for another non-limiting exemplary embodiment of the cable tie restraining apparatus of the disclosure described herein.

FIG. 2 illustrates another non-limiting exemplary embodiment of the of the cable tie restraining apparatus 100B of the disclosure described herein. Here, the cable tie safety restraining apparatus is shown here having a rounded inverted hook-like projection 102B that forms a partial semi-circle. Here, the rounded semi-circle configuration of projection 102B can allow the restrained individual's hand and wrist to abut comfortably against it. In addition, it is noted that that one end of the projections 104B is secured or affixed to a base of the cable tie apparatus whereas an opposing end is not in contact with the cable tie, thereby creating a space or gap exists between the cable tie and projection 102B. Projection 102B is further adapted to bend, articulate, and recoil. In addition, the area under projection 102B allows an operator or user to place shears or any cutting tool at region 104B of the cable tie thereby safely cutting the cable, such that the shears or cutting tool does not make contact with a person's hand, arm, or wrist while secured within the loop of the cable tie apparatus. Specifically, because one end of projection 102B is not attached to the cable tie, the cable tie can be successfully cut and removed from the restrained individual when it is cut at or around region 104B. Here, the extended length of projection 102B may be from about 0.05 in. up to and including 3 in. In addition, the edges of projection 102B may also be rounded or shaved, and further include a smooth exterior surface.

Figure 3:
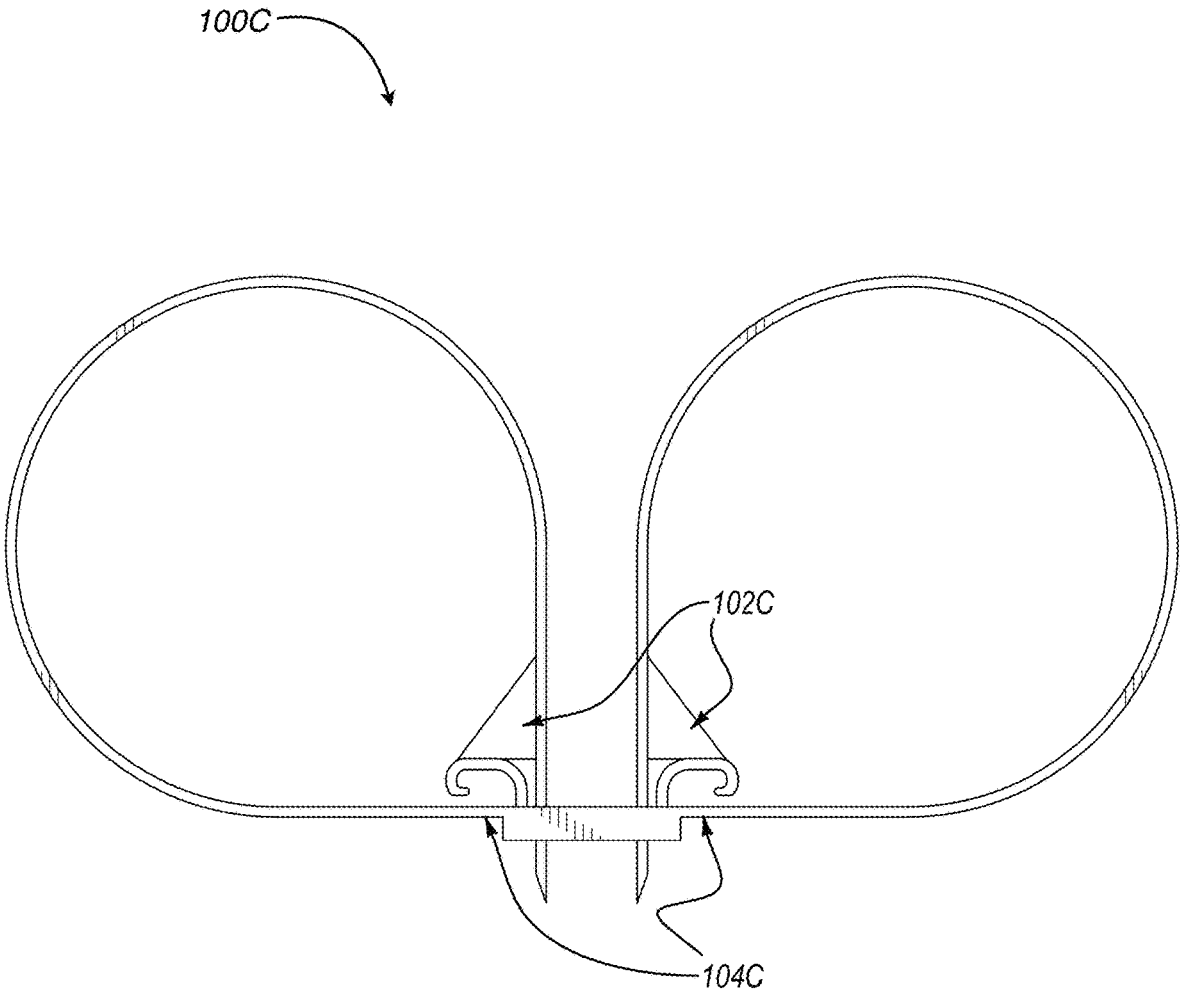
FIG. 3 illustrates a side view for another non-limiting exemplary embodiment of the cable tie restraining apparatus of the disclosure described herein.

FIG. 3 illustrates another non-limiting exemplary embodiment of the cable tie restraining apparatus 100C of the disclosure described herein. Here, the cable tie safety restraining apparatus is shown here having an inverted hook-like projection 102C having a substantially flat top with rounded ends. Here, the rounded end region and substantially flat top region configuration of projection 102C can allow the restrained individual's hand and wrist to abut comfortably against it. In addition, it is noted that that one end of the projections 104C is secured or affixed to a base of the cable tie apparatus whereas an opposing end is not in contact with the cable tie, thereby creating a space or gap exists between the cable tie and projection 102C. Projection 102C is further adapted to bend, articulate, and recoil. In addition, the area under projection 102C allows an operator or user to place shears or any cutting tool at region 104C of the cable tie thereby safely cutting the cable, such that the shears or cutting tool does not make contact with a person's hand, arm, or wrist while secured within the loop of the cable tie apparatus. Specifically, because one end of projection 102C is not attached to the cable tie, the cable tie can be successfully cut and removed from the restrained individual when it is cut at or around region 104C. Here, the extended length of projection 102C may be from about 0.05 in. up to and including 3 in. In addition, the edges of projection 102C may also be rounded or shaved, and further include a smooth exterior surface.

Figure 4:
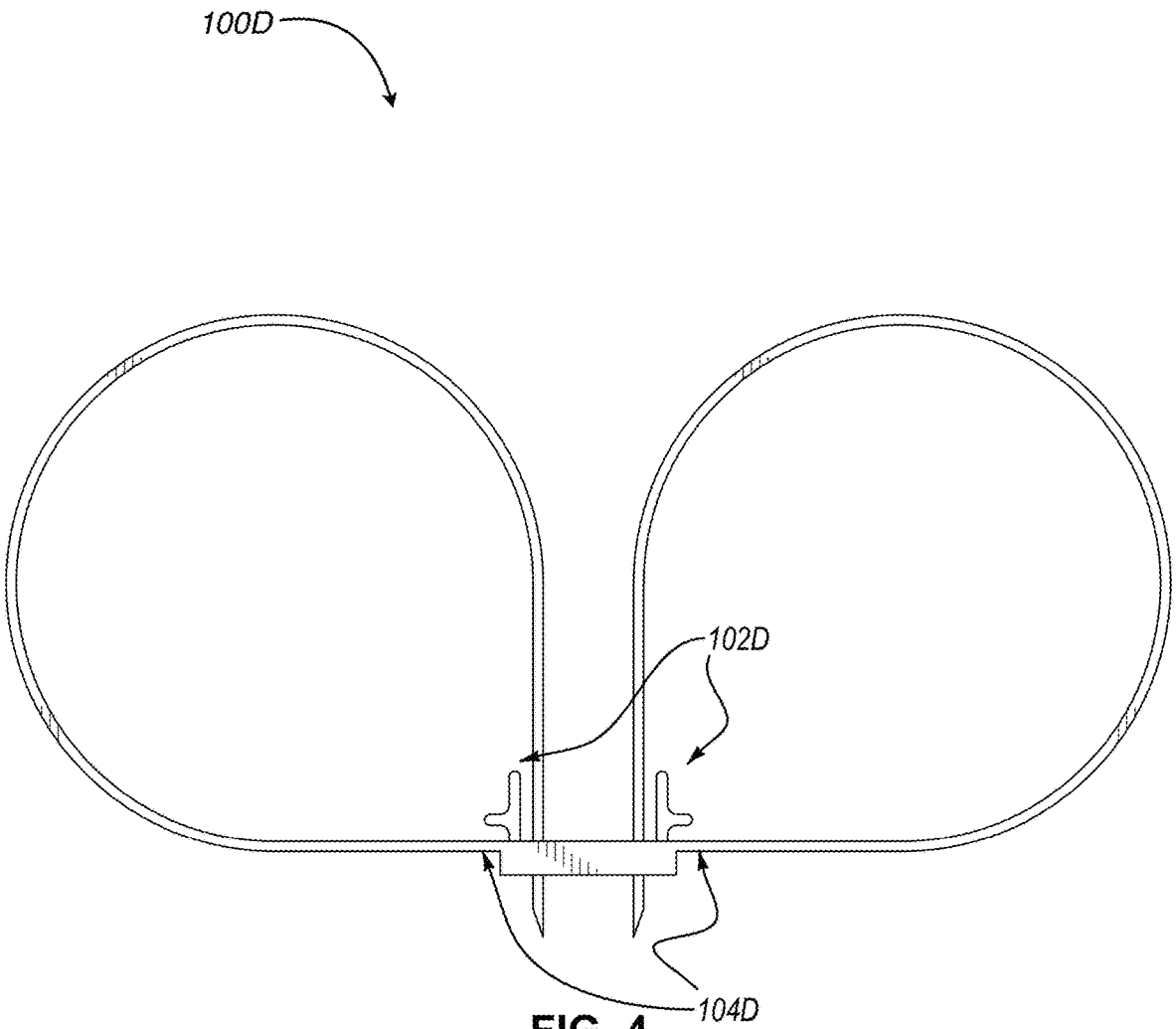
FIG. 4 illustrates a side view for another non-limiting exemplary embodiment of the cable tie restraining apparatus of the disclosure described herein.

FIG. 4 illustrates another non-limiting exemplary embodiment of the cable tie restraining apparatus 100D of the disclosure described herein. Here, the cable tie safety restraining apparatus is shown here having L-shape or T-shaped projections 102D. Here, the L-shaped or T-shaped configuration includes a substantially upright region with a laterally perpendicular protruding region with respect thereto, wherein the protruding region creates a rounded corner with the upstanding region above it and space or gap beneath it. The rounded corner region configuration of projection 102D can allow the restrained individual's hand and wrist to abut comfortably against it. In addition, it is noted that that one end of the upstanding region of projection 102D is secured or affixed to a base of the cable tie apparatus whereas the laterally protruding region is not in contact with the cable tie, thereby creating the space or gap exists between the cable tie and projection 102D. Projection 102D is further adapted to bend, articulate, and recoil. In addition, the area under the laterally protruding region of projection 102D allows an operator or user to place shears or any cutting tool at region 104D of the cable tie thereby safely cutting the cable, such that the shears or cutting tool does not make contact with a person's hand, arm, or wrist while secured within the loop of the cable tie apparatus. Specifically, because one end of projection 102D is not attached to the cable tie, the cable tie can be successfully cut and removed from the restrained individual when it is cut at or around region 104D. Here, the extended length of the upstanding region or laterally protruding region of projection 102D may be from 0.05 in. up to and including 3 in. In addition, the edges of projection 102D may also be rounded or shaved, and further include a smooth exterior surface.

Figure 5:
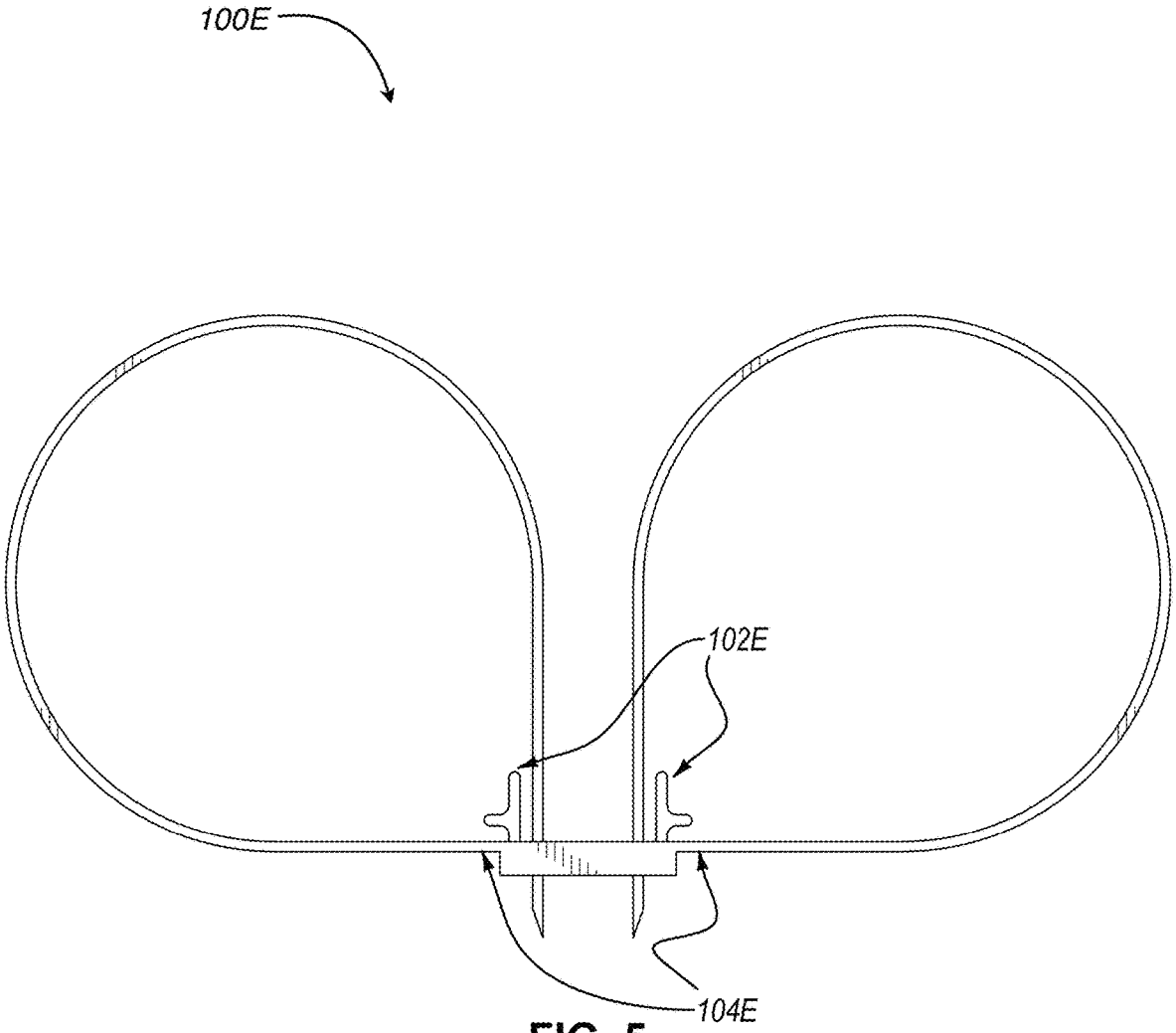
FIG. 5 illustrates a side view for another non-limiting exemplary embodiment of the cable tie restraining apparatus of the disclosure described herein.

FIG. 5 illustrates another non-limiting exemplary embodiment of the of the cable tie restraining apparatus 100E of the disclosure described herein. Here, the cable tie safety restraining apparatus is shown here having L-shape projections 102E. Here, the L-shaped configuration includes a substantially upright region with a perpendicular laterally protruding region with respect thereto, wherein the protruding region creates a rounded corner with the upstanding region above it and space or gap beneath it. The rounded corner region configuration of projection 102E can allow the restrained individual's hand and wrist to abut comfortably against it. In addition, it is noted that that one end of the upstanding region of projection 102E is secured or affixed to a base of the cable tie apparatus whereas the laterally protruding region is not in contact with the cable tie, thereby creating the space or gap exists between the cable tie and projection 102E. Projection 102E is further adapted to bend, articulate, and recoil. In addition, the area under the laterally protruding region of projection 102E allows an operator or user to place shears or any cutting tool at region 104E of the cable tie thereby safely cutting the cable, such that the shears or cutting tool does not make contact with a person's hand, arm, or wrist while secured within the loop of the cable tie apparatus. Specifically, because one end of projection 102E is not attached to the cable tie, the cable tie can be successfully cut and removed from the restrained individual when it is cut at or around region 104E. Here, the extended length of the upstanding region or laterally protruding region of projection 102E may be from 0.05 in. up to and including 3 in. In addition, the edges of projection 102E may also be rounded or shaved, and further include a smooth exterior surface.

Figure 6:
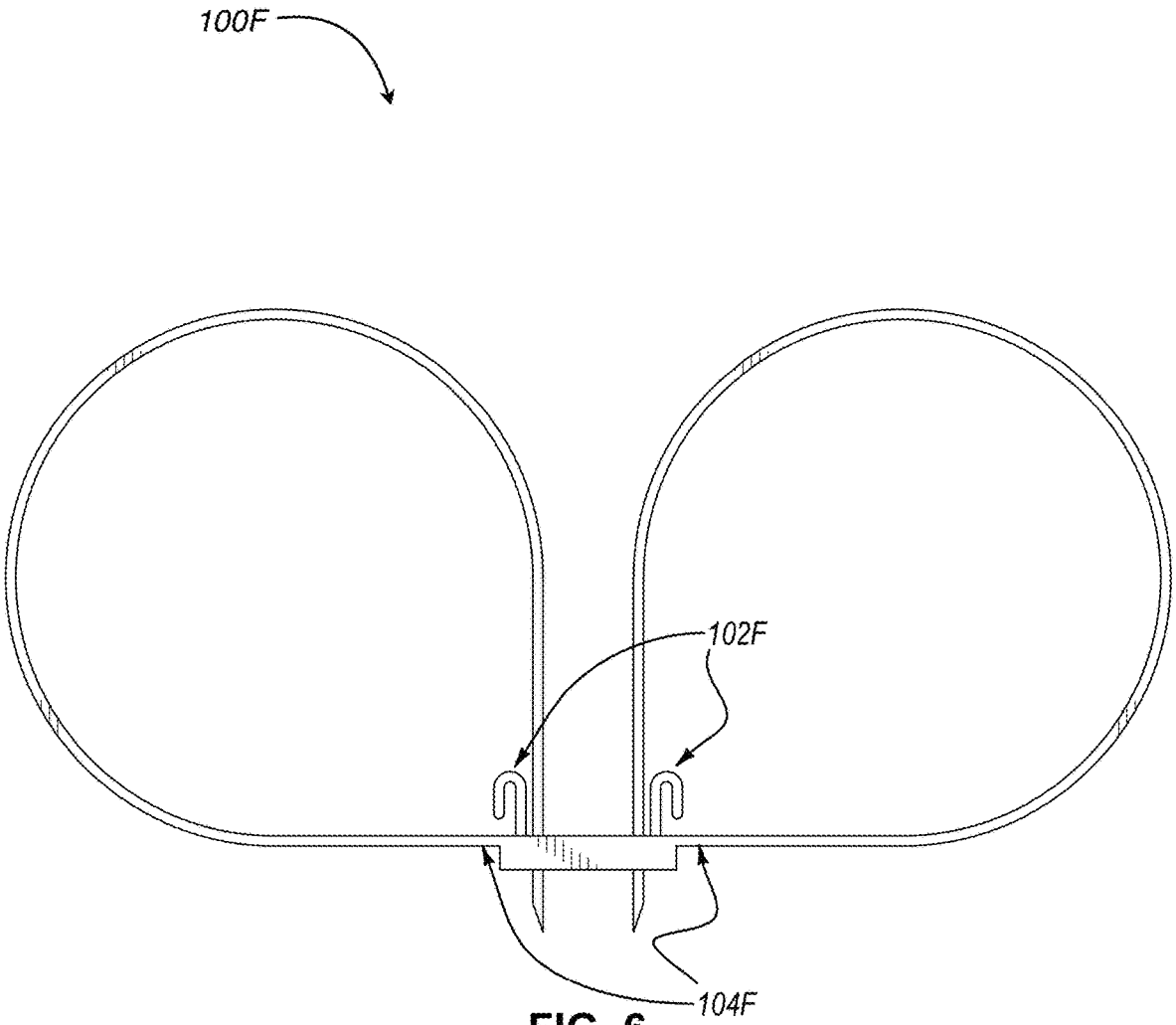
FIG. 6 illustrates a side view for another non-limiting exemplary embodiment of the cable tie restraining apparatus of the disclosure described herein.

FIG. 6 illustrates another non-limiting exemplary embodiment of the of the cable tie restraining apparatus 100F of the disclosure described herein. Here, the cable tie safety restraining apparatus is shown here having a rounded inverted J-hook projection 102F. Here, the inverted J-hook and rounded top region configuration of projection 102F can allow the restrained individual's hand and wrist to abut comfortably against it. In addition, it is noted that that one end of the projections 104F is secured or affixed to a base of the cable tie apparatus whereas an opposing end is not in contact with the cable tie, thereby creating a space or gap exists between the cable tie and projection 102F. Projection 102F is further adapted to bend, articulate, and recoil. In addition, the area under projection 102F allows an operator or user to place shears or any cutting tool at region 104F of the cable tie thereby safely cutting the cable, such that the shears or cutting tool does not make contact with a person's hand, arm, or wrist while secured within the loop of the cable tie apparatus. Specifically, because one end of projection 102F is not attached to the cable tie, the cable tie can be successfully cut and removed from the restrained individual when it is cut at or around region 104F. Here, the extended length of projection 102F may be from 0.05 in. up to and including 3 in. In addition, the edges of projection 102F may also be rounded or shaved, and further include a smooth exterior surface.

Figure 7A:
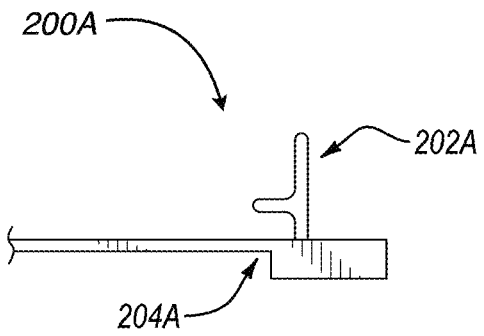
FIG. 7A illustrates a close-up side view for another non-limiting exemplary embodiment of the disclosure described herein.
Figure 7B:
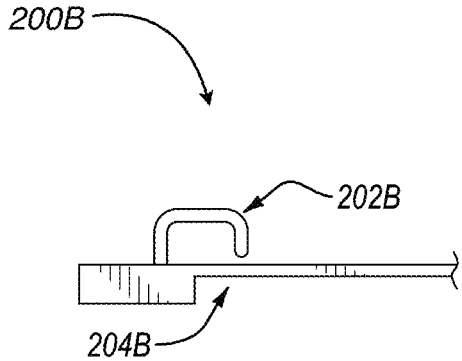
FIG. 7B illustrates a close-up side view for another non-limiting exemplary embodiment of the disclosure described herein.
Figure 7C:
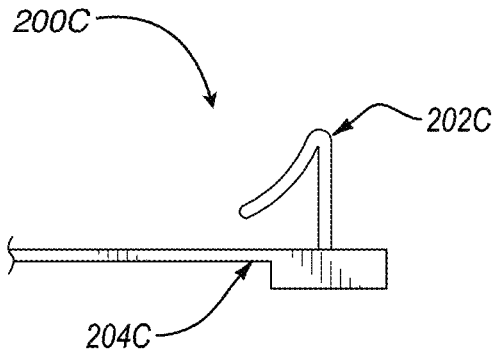
FIG. 7C illustrates a close-up side view for another non-limiting exemplary embodiment of the disclosure described herein.
Figure 7D:
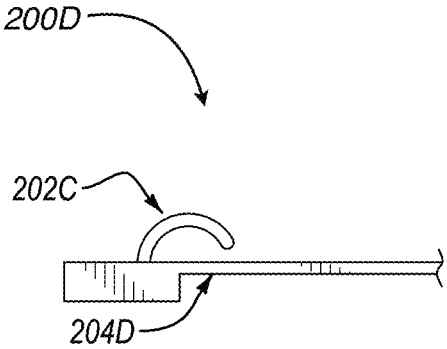
FIG. 7D illustrates a close-up side view for another non-limiting exemplary embodiment of the disclosure described herein.
Figure 7E:
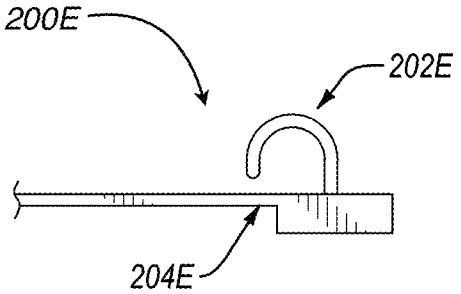
FIG. 7E illustrates a close-up side view for another non-limiting exemplary embodiment of the disclosure described herein.
Figure 7F:
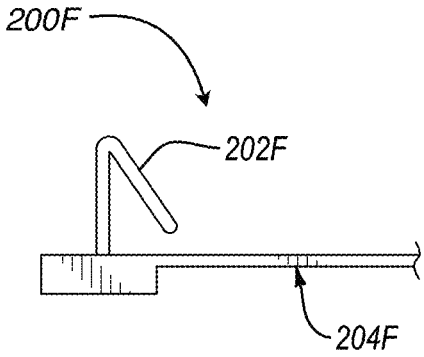
FIG. 7F illustrates a close-up side view for another non-limiting exemplary embodiment of the disclosure described herein.

FIGS. 7A-7E illustrate alternative embodiments of the cable safety tie restraining apparatuses 200A-200F of the disclosure described herein. Specifically, the embodiments of FIGS. 7A-7E illustrate the safety projection of the disclosure described herein being incorporated in a single loop cable tie. Specifically, FIG. 7A illustrates a configuration of projection 202A resembling that of FIG. 4, including the cutting region 204A. FIG. 7B illustrates a configuration of projection 202B resembling that of FIG. 3, including the cutting region 204B. FIG. 7C illustrates a configuration of projection 202C resembling that of FIG. 1A, including the cutting region 204C. FIGS. 7D and 7E illustrates a configuration of projections 202D and 202E, respectively, wherein each resemble that of FIG. 2, including cutting regions 204D and 202E. FIG. 7F illustrates a configuration of projection 202F resembling that of FIG. 1A, albeit without a curvature to its sloping end, and further including cutting region 204F.

It is contemplated within the scope of the disclosure described herein that the cable tie apparatuses 100A-200F disclosed with respect to FIGS. 1A-7F may be made of any type of material, including but not limited to plastic, polymer, or metal. In addition, any of projections 102A-202F may also be made of any type of material, which may be the same or different than that of the cable tie apparatus. In addition any of projections 102A-202F of the cable tie apparatus may also be molded with the cable tie apparatus in one unitary piece. Alternatively, any of projections 102A-202F may also be a separate components that are integrated with and secured to the cable tie apparatus.

Figure 8:
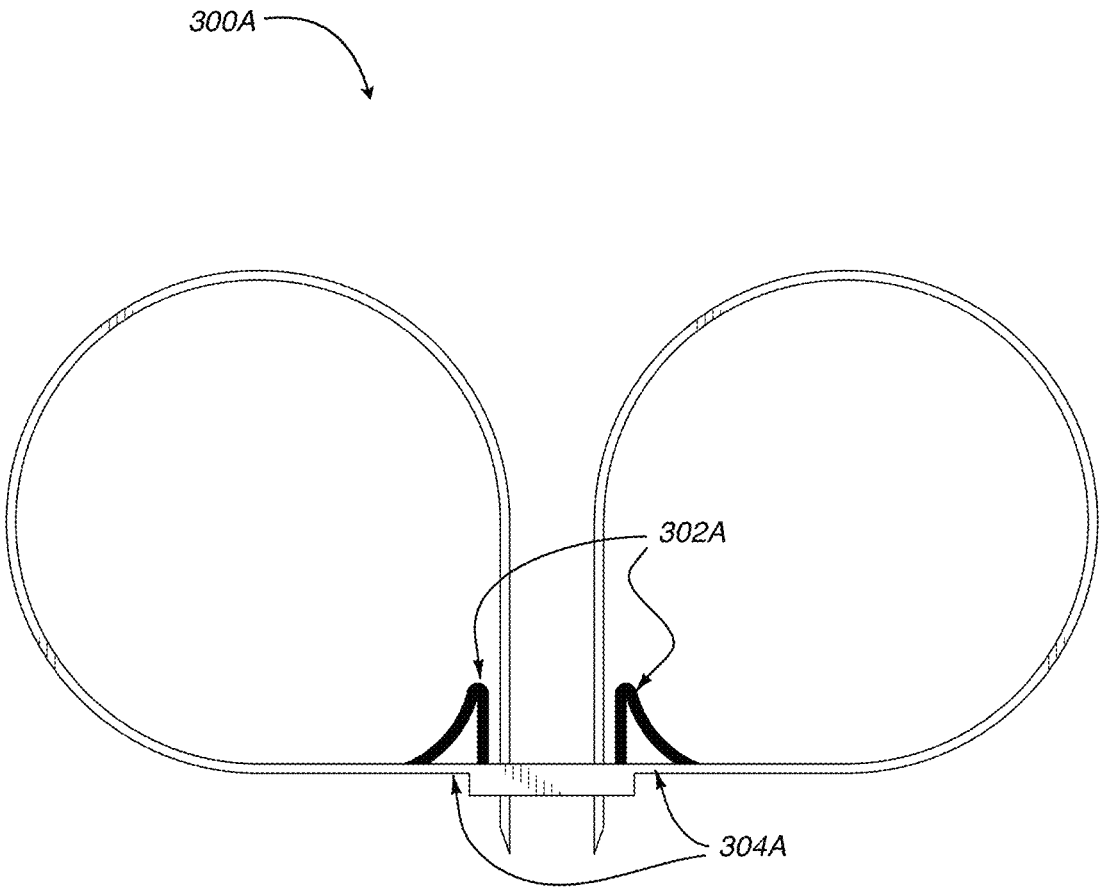
FIG. 8 illustrates a side view for another non-limiting exemplary embodiment of the disclosure described herein.

FIG. 8 illustrates another non-limiting exemplary embodiment of the cable tie restraining apparatus 300A of the disclosure described herein. Here, the cable tie safety restraining apparatus is shown here having inverted hooklike projections 302A having an upright or upstanding region followed by a downward sloping region having a slight curvature. Notably, the curvature can allow for more comfort to the restrained hand or wrist of the restrained person by conforming to the curvature of the hand or wrist. Here, it is noted that one end of the projections 302A is secured or affixed to the strap itself near its proximal region, but not at the base of the cable tie apparatus, and wherein an opposing end is not in contact with the base of the cable tie, thereby creating a space or gap between the cable tie and projection 302A. Projection 302A is further adapted to bend, articulate, and recoil. In addition, the area under projection 302A allows an operator or user to place shears or any cutting tool at region 304A of the cable tie thereby safely cutting the cable, such that the shears or cutting tool does not make contact with a person's hand, arm, or wrist while secured within the loop of the cable tie apparatus. Specifically, because one end of projection 302A is not attached to the cable tie, the cable tie can be successfully cut and removed from the restrained individual when it is cut at or around region 304A. Further, the upstanding region of the can preferably be about 0.5 in.; however, it is contemplated within the scope of the present disclosure described herein that projection 302A may have any height or length, such as from 0.1 in. up to and including 2 in., or any slope or angle. In addition, the edges of projection 302A may also be rounded or shaved, and further include a smooth exterior surface.

Figure 9:
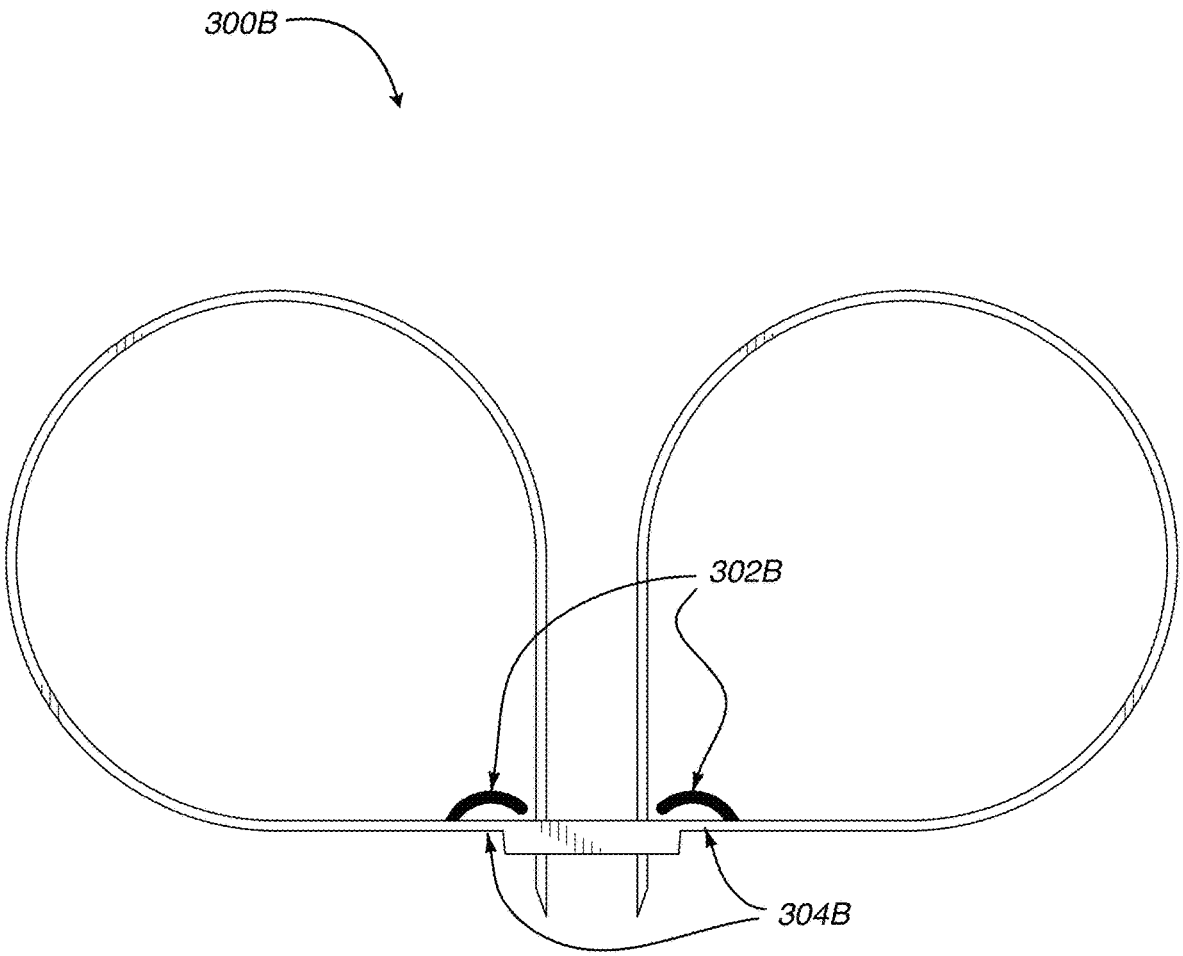
FIG. 9 illustrates a side view for another non-limiting exemplary embodiment of the disclosure described herein.

FIG. 9 illustrates another non-limiting exemplary embodiment of the cable tie restraining apparatus 300B of the disclosure described herein. Here, the cable tie safety restraining apparatus is shown here having a rounded inverted hook-like projection 302B that forms a partial semi-circle. Here, the rounded semi-circle configuration of projection 302B can allow the restrained individual's hand and wrist to abut comfortably against it. In addition, it is noted that that one end of the projections 304B is secured or affixed to the strap near its proximal region, but not at the base of the cable tie apparatus, wherein an opposing end is not in contact with the base region of the cable tie, thereby creating a space or gap exists between the cable tie and projection 302B. Projection 302B is further adapted to bend, articulate, and recoil. In addition, the area under projection 302B allows an operator or user to place shears or any cutting tool at region 304B of the cable tie thereby safely cutting the cable, such that the shears or cutting tool does not make contact with a person's hand, arm, or wrist while secured within the loop of the cable tie apparatus. Specifically, because one end of projection 302B is not attached to the cable tie, the cable tie can be successfully cut and removed from the restrained individual when it is cut at or around region 304B. Here, the extended length of projection 302B may be from about 0.05 in. up to and including 3 in. In addition, the edges of projection 302B may also be rounded or shaved, and further include a smooth exterior surface.

Figure 10:
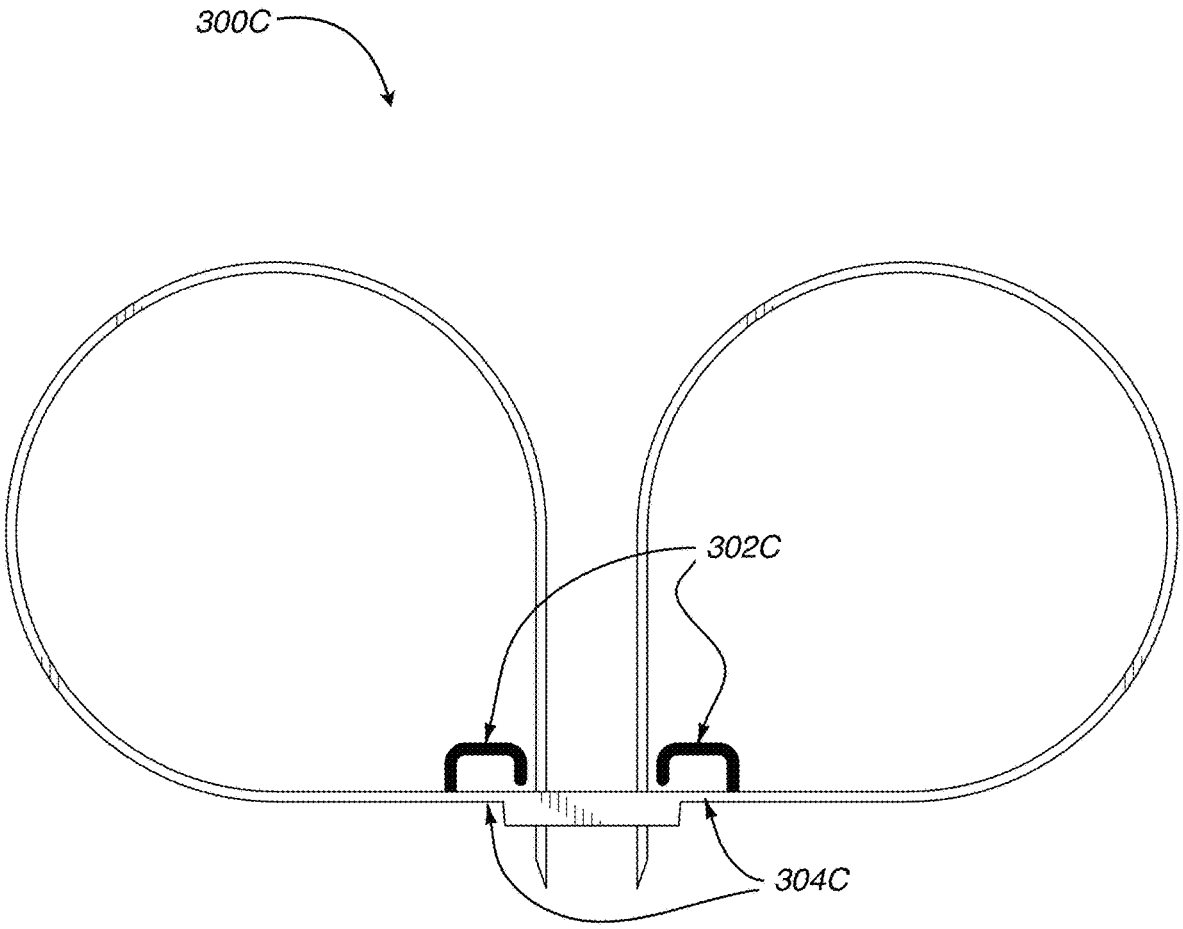
FIG. 10 illustrates a side view for another non-limiting exemplary embodiment of the disclosure described herein.

FIG. 10 illustrates another non-limiting exemplary embodiment of the cable tie restraining apparatus 300C of the disclosure described herein. Here, the cable tie safety restraining apparatus is shown here having an inverted hook-like projection 302C having a substantially flat top with rounded ends. Here, the rounded end region and substantially flat top region configuration of projection 302C can allow the restrained individual's hand and wrist to abut comfortably against it. In addition, it is noted that that one end of the projections 304C is secured or affixed to the strap of the cable tie apparatus near its proximal region, but not at the base, whereas an opposing end is not in contact with the base of the cable tie, thereby creating a space or gap exists between the cable tie and projection 302C. Projection 302C is further adapted to bend, articulate, and recoil. In addition, the area under projection 302C allows an operator or user to place shears or any cutting tool at region 304C of the cable tie thereby safely cutting the cable, such that the shears or cutting tool does not make contact with a person's hand, arm, or wrist while secured within the loop of the cable tie apparatus. Specifically, because one end of projection 302C is not attached to the cable tie, the cable tie can be successfully cut and removed from the restrained individual when it is cut at or around region 304C. Here, the extended length of projection 302C may be from about 0.05 in. up to and including 3 in. In addition, the edges of projection 302C may also be rounded or shaved, and further include a smooth exterior surface.

Figure 11:
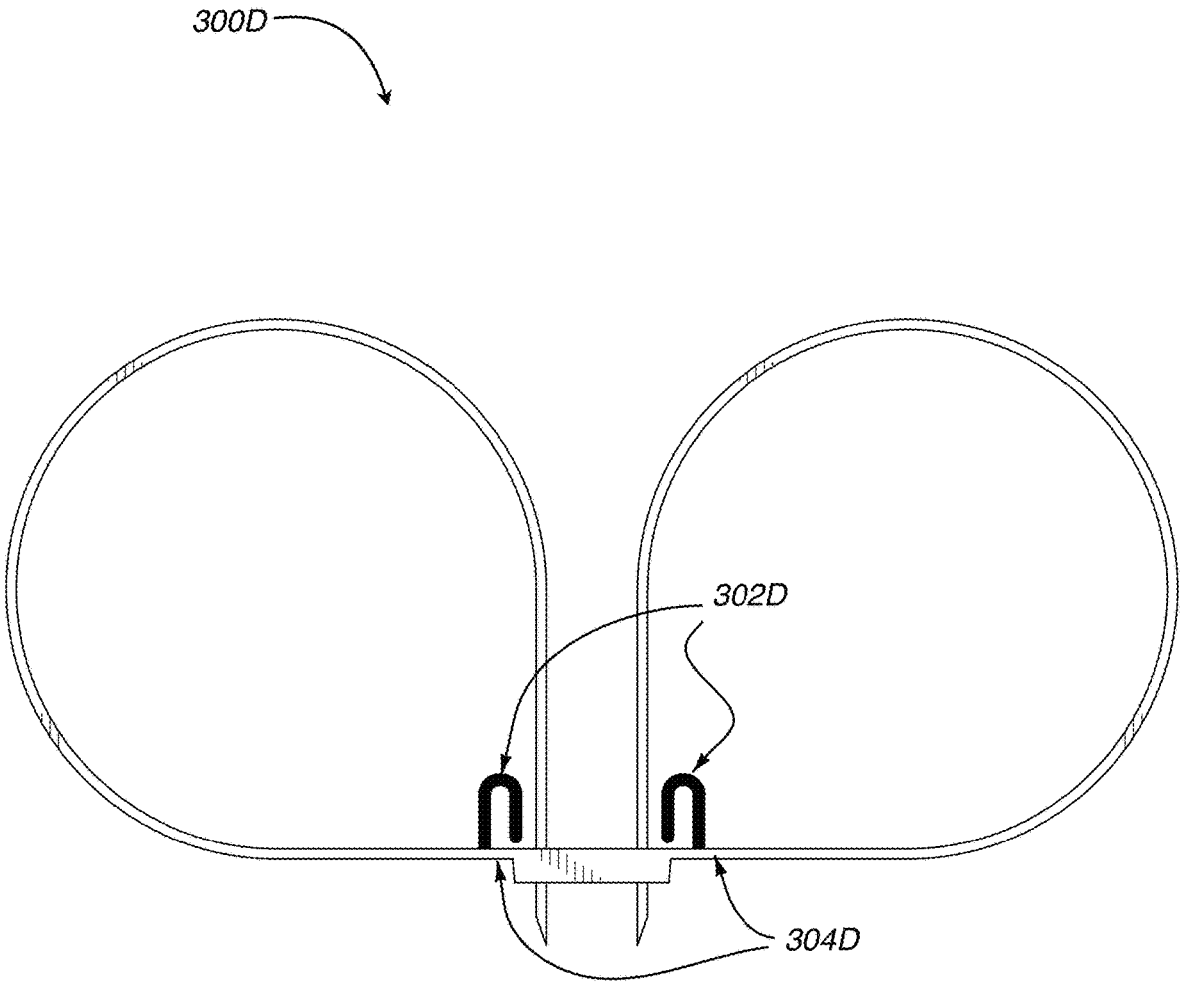
FIG. 11 illustrates a side view for another non-limiting exemplary embodiment of the disclosure described herein.

FIG. 11 illustrates another non-limiting exemplary embodiment of the cable tie restraining apparatus 300D of the disclosure described herein. Here, the cable tie safety restraining apparatus is shown here having a rounded inverted J-hook projection 302D. Here, the inverted J-hook and rounded top region configuration of projection 302D can allow the restrained individual's hand and wrist to abut comfortably against it. In addition, it is noted that that one end of the projections 104F is secured or affixed to the strap of the cable tie apparatus near its proximal region, but not at the base of the cable tie apparatus, and wherein an opposing end is not in contact with the base of the cable tie, thereby creating a space or gap exists between the cable tie and projection 302D. Projection 302D is further adapted to bend, articulate, and recoil. In addition, the area under projection 302D allows an operator or user to place shears or any cutting tool at region 304D of the cable tie thereby safely cutting the cable, such that the shears or cutting tool does not make contact with a person's hand, arm, or wrist while secured within the loop of the cable tie apparatus. Specifically, because one end of projection 302F is not attached to the cable tie, the cable tie can be successfully cut and removed from the restrained individual when it is cut at or around region 304F. Here, the extended length of projection 302F may be from 0.05 in. up to and including 3 in. In addition, the edges of projection 302F may also be rounded or shaved, and further include a smooth exterior surface.

Figure 12A:
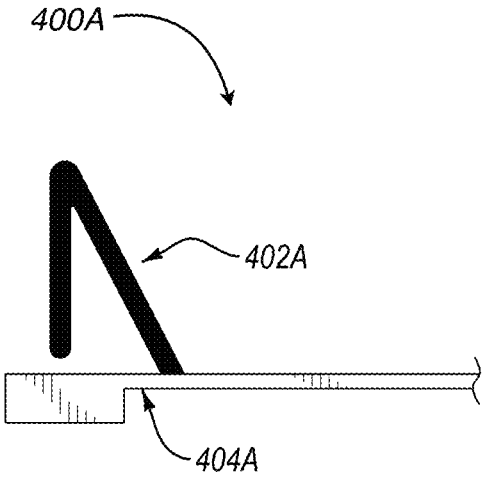
FIG. 12A illustrates a close-up side view for another non-limiting exemplary embodiment of the disclosure described herein.
Figure 12B:
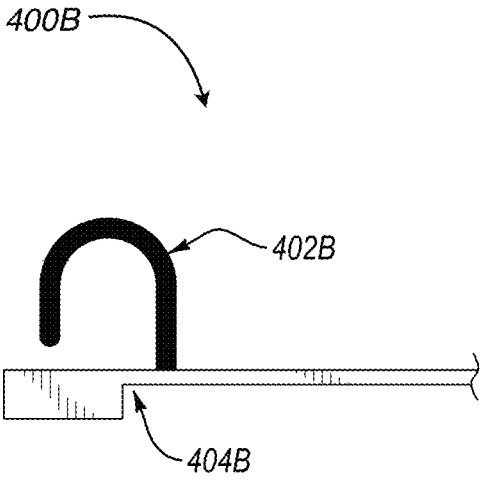
FIG. 12B illustrates a close-up side view for another non-limiting exemplary embodiment of the disclosure described herein.
Figure 12C:
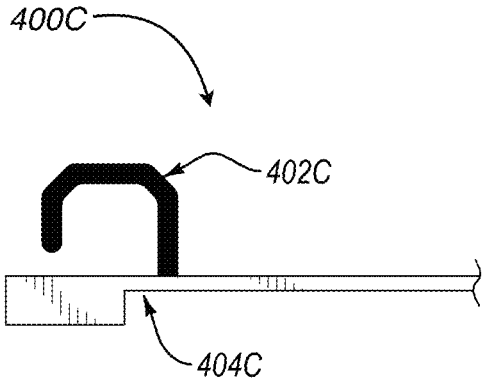
FIG. 12C illustrates a close-up side view for another non-limiting exemplary embodiment of the disclosure described herein.
Figure 12D:
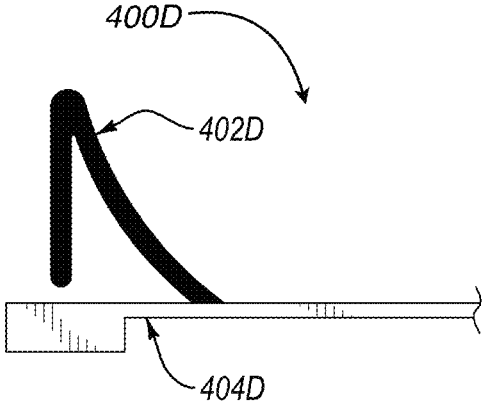
FIG. 12D illustrates a close-up side view for another non-limiting exemplary embodiment of the disclosure described herein.

FIGS. 12A-12D illustrate alternative embodiments of the cable safety tie restraining apparatuses 400A-400D of the disclosure described herein. Specifically, the embodiments of FIGS. 12A-12D illustrate the safety projection of the disclosure described herein being incorporated in a single loop cable tie. Specifically, FIG. 12A illustrates a configuration of projection 402A resembling that of FIG. 8 but having flat downward slope in lieu of a curvature, including the cutting region 404A. FIG. 12B illustrates a configuration of projection 402B resembling that of FIG. 11, including the cutting region 404B. FIG. 7C illustrates a configuration of projection 402C resembling that of FIG. 10, including the cutting region 404C. FIG. 12D illustrates a configuration of projection 402D resembling that of FIG. 8, including cutting region 404D.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A cable tie or strap, comprising:

a base having a first opening and a second opening therein;

a first strap extending from the base and secured within the first opening of the base and a second strap extending from the base and secured within the second opening of the base, such that the first strap forms a first closed loop relative to the base and the second strap forms a second closed loop relative to the base; and a first protruding member and a second protruding member coupled to the base, wherein the first protruding member is disposed above the base and within the first closed loop and the second protruding member is disposed above the base and within the second closed loop, wherein each of the first and second protruding members comprise an upstanding region and a curved sloping region, wherein a distal end of each curved sloping region extends beyond the base such that each curved sloping region is at least partially disposed above a proximal end of each of the first strap and the second strap.

2. The cable tie or strap of claim 1, wherein each of the first and second protruding members further extend in a downward configuration.

3. The cable tie or strap of claim 2, wherein each of the first and second protruding members form a hook.

4. The cable tie or strap of claim 1, wherein a proximal end of each of the first and second protruding members are secured to the base and the distal end of each of the first and second protruding members are free with respect to the base.

5. The cable tie or strap of claim 1, wherein the first and second protruding members forms an open space or gap underneath.

6. A cable tie or strap, comprising:

a base having a first opening and a second opening therein;

a first strap extending from the base and a second strap extending from the base; and a first protruding member and a second protruding member coupled to the base, wherein the first protruding member is disposed above the base and outside of the first opening or second opening of the base, and the second protruding member is disposed above the base and outside of the first opening or second opening of the base, wherein each of the first and second protruding members comprise an upstanding region and an arched region, wherein a distal end of each arched region extends beyond the base such that each arched region is at least partially disposed above a proximal end of each of the first strap and the second strap.

7. The cable tie or strap of claim 6, wherein each of the first and second protruding members form a hook.

8. The cable tie or strap of claim 6, wherein a proximal end of each of the first and second protruding members are secured to the base and the distal end of each of the first and second protruding members are free with respect to the base.

9. The cable tie or strap of claim 6, wherein the first and second protruding members form an open space or gap underneath.

10. The cable tie or strap or claim 6, wherein the first strap is secured within the first opening of the base and the second strap is secured within the second opening of the base, such that the first strap forms a first closed loop relative to the base and the second strap forms a second closed loop relative to the base.

11. The cable tie or strap of claim 10, wherein the first closed loop encloses the first protruding member therein, and the second closed loop encloses the second protruding member therein.

12. The cable tie or strap of claim 11, wherein each arched region of the first and second protruding member is configured to abut against a hand or wrist of a user.

* * * * *